US005503460A

United States Patent [19]

Yu

[11] Patent Number: 5,503,460

[45] Date of Patent: Apr. 2, 1996

[54] SAFETY DEVICE FOR A FOLDABLE CHAIR

[76] Inventor: Ali Yu, 324, Alley 52, Lane 46, Sec. 2, Yuanta Rd., Yuanlin Chen, Changhau Hsien, Taiwan

[21] Appl. No.: 406,561

[22] Filed: Mar. 20, 1995

[51] Int. Cl.[6] ..... A47C 9/00

[52] U.S. Cl. ..... 297/461; 297/16.1; 108/120

[58] Field of Search ..... 297/56, 461, 16.1, 297/534; 108/118, 120, 131; 248/164, 432

[56] References Cited

U.S. PATENT DOCUMENTS

| | | | |
|---|---|---|---|
| 633,762 | 9/1899 | Kade | 248/432 |
| 2,285,597 | 6/1942 | Lutz et al. | 108/120 |
| 2,540,875 | 2/1951 | Genge | 108/120 |

FOREIGN PATENT DOCUMENTS

| | | | |
|---|---|---|---|
| 687207 | 5/1964 | Canada | 297/56 |
| 923267 | 2/1955 | Germany | 297/56 |
| 1941803 | 2/1971 | Germany | 297/56 |
| 2183182 | 7/1987 | United Kingdom | 108/131 |

*Primary Examiner*—Peter M. Cuomo
*Assistant Examiner*—Anthony D. Barfield
*Attorney, Agent, or Firm*—Welsh & Katz, Ltd.

[57] ABSTRACT

A safety device is provided for a foldable chair which includes a seat, a pair of base members substantially inverted L-shaped in section each including a horizontal section fixedly mounted to an underside of the seat, a pair of first leg portions each having an upper end pivotally engaged with a first end of a vertical section of a corresponding one of the base members, a first pivot member and a second pivot member each having a first end pivotally engaged with a second end of the vertical section of a corresponding one of the base members, an elongated first slot being horizontally defined in a mediate portion of the first pivot member, a pair of second leg portions each having an upper end pivotally engaged with the second end of the first and second pivot members. The safety device includes an operating member slidably mounted between the first pivot member and the vertical section of the associated base member, an elongated second slot defined in a mediate portion of the operating member, a pivot axle including a first end extending through the second slot and attached to the vertical section of the associated base member and including a second end pivotally engaged with the first end of the first pivot member, a movable member including a first end attached to the second end of the operating member and a second end movably extending through the first slot, a spring having a first end attached to the second end of the pivot axle and a second end attached to the second end of the movable member.

4 Claims, 4 Drawing Sheets

SAFETY DEVICE FOR A FOLDABLE CHAIR

BACKGROUND OF THE INVENTION

1. Field of Invention

The present invention relates to a safety device, and more particularly to a safety device for a foldable chair.

2. Related Prior Art

The closest prior art of a safety device for a foldable chair was disclosed in the Applicant's own patent application U.S. Ser. No. 08/287,743, filed on Aug. 9, 1994. However, by such an arrangement, when the foldable chair is needed to be fully expanded for a user to be seated thereon, the user will likely forget to move the linking bar 20 together with the control member 10 to a safety position where the relative pivotal movement between the first and second leg portions 50 and 51 is limited, thereby easily incurring a tipping of the chair when the user is unintentionally seated on one side of the seat 40 near the first leg portions 50, so apt to causing danger and possibly injuring the user.

The present invention has arisen to mitigate and/or obviate the disadvantages of the conventional foldable chair.

SUMMARY OF THE INVENTION

The primary objective of the present invention is to provide a safety device for a foldable chair.

Another objective is to provide a safety device which can afford to provide great safety for the foldable chair.

In accordance with one aspect of the present invention, there is provided a safety device for a foldable chair which comprises a seat having an underside. A pair of base members substantially inverted L-shaped in section each include a horizontal section fixedly mounted to the underside of the seat and a vertical section having a first end and a second end. A pair of first leg portions each have an upper end pivotally engaged with the first end of the vertical section of a corresponding one of the base members.

A first pivot member and a second pivot member each have a first end pivotally engaged with the second end of the vertical section of a corresponding one of the base members and a second end, and an elongated first slot is horizontally defined in a mediate portion of the first pivot member. A pair of second leg portions each have an upper end pivotally engaged with the second end of the associated first and second pivot members. The first and second leg portions are pivotally engaged with each other, thereby allowing pivotal displacement therebetween.

The safety device comprises an operating member slidably mounted between the first pivot member and the vertical section of the associated base member and including a first end and a second end, and an elongated second slot is defined in a mediate portion of the operating member. A pivot axle includes a first end extending through the second slot and attached to the vertical section of the associated base member and includes a second end pivotally engaged with the first end of the first pivot member. A movable member includes a first end attached to the second end of the operating member and a second end movably extending through the first slot. A spring has a first end attached to the second end of the pivot axle and a second end attached to the second end of the movable member.

The movable member is restricted to move along the first slot such that the operating member is displaced between a first position where the first end of the operating member aligns with the first end of the first pivot member such that the first pivot member together with the operating member is pivotally engaged with the vertical section of the associated base member about the pivot axle, and a second position where the first end of the operating member extends beyond the first end of the first pivot member such that the first pivot member is not pivotally engaged with the vertical section of the associated base member by means a rotational movement of the operating member being limited by the horizontal section of the associated base member, thereby preventing the first pivot member from pivoting relative to the vertical section of the associated base member about the pivot axle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
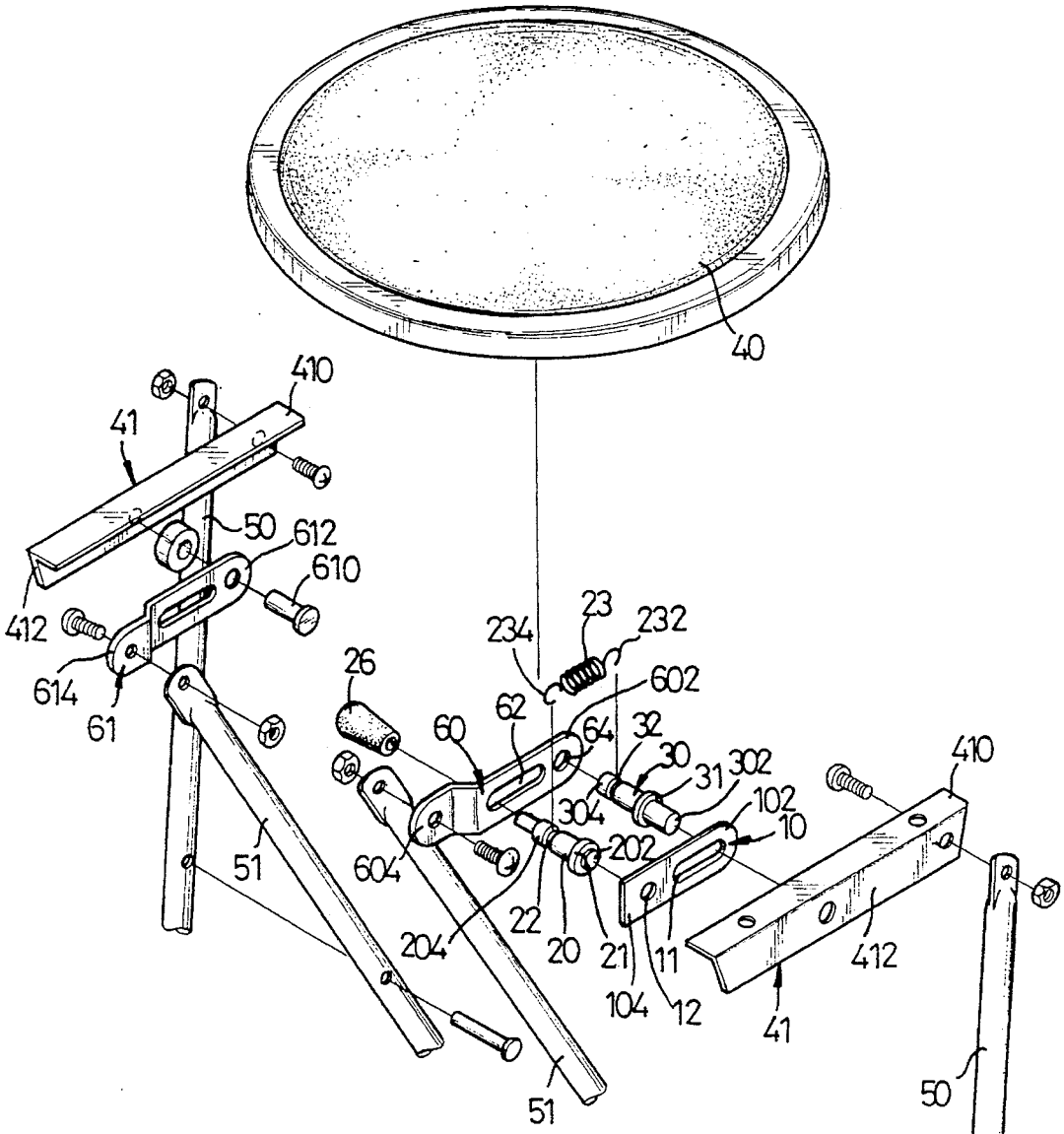
FIG. 1 is an exploded view of a safety device for a foldable chair in accordance with the present invention.
Figure 2:
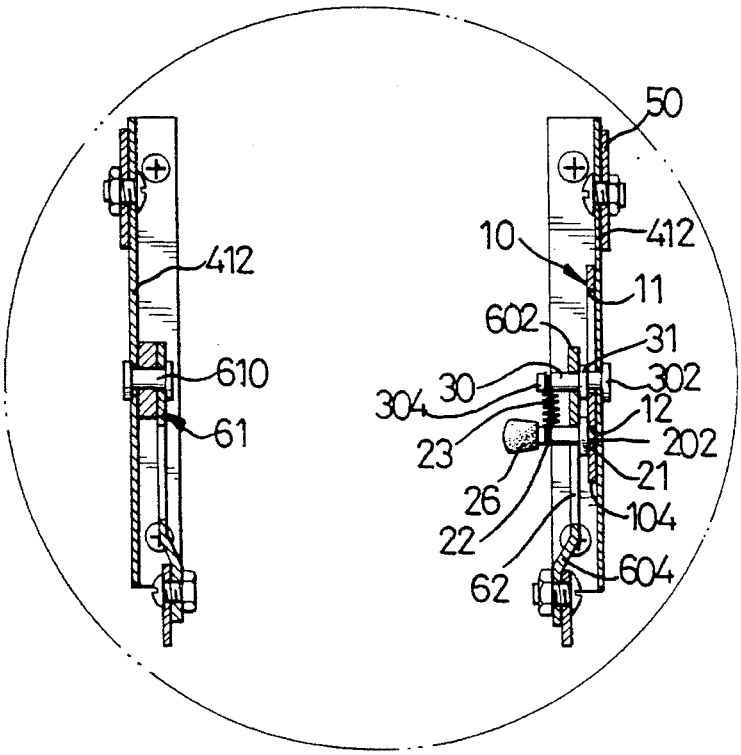
FIG. 2 is a top plan cross-sectional view of the safety device which is arranged in a first status.

Referring to the drawings, and initially to FIGS. 1 and 2, a safety device in accordance with the present invention is provided for a foldable chair which comprises a seat 40 with an underside. A pair of base members 41 substantially inverted L-shaped in section each includes a horizontal section 410 fixedly mounted to the underside of the seat 40 and a vertical section 412 having a first end and a second end. A pair of first leg portions 50 each have an upper end pivotally engaged with the first end of the vertical section 412 of a corresponding one of the base members 41.

A first pivot member 60 and a second pivot member 61 respectively have a first end 602 and 612 pivotally engaged with the second end of the vertical section 412 of a corresponding one of the base members 41 and respectively have a second end 604 and 614, and an elongated first slot 62 is horizontally defined in a mediate portion of the first pivot member 60. Preferably, a pin 610 extends through a hole 612 defined in the first end 612 of the second pivot member 61 and is riveted to the vertical section 412 of the associated base member 41 such that the second pivot member 61 is pivoted to the associated vertical section 412 about the pin 610.

A pair of second leg portions 51 each have an upper end respectively and pivotally engaged with the second end 604 and 614 of the associated first and second pivot members 60 and 61. The first and second leg portions 50 and 51 are pivotally engaged with each other, thereby allowing pivotal displacement therebetween. It is to be noted that, the pivotal movement of the first and second pivot members 60 and 61 is respectively limited by means of the horizontal section 410 of a corresponding one of the base members 41.

The safety device comprises an operating member 10 slidably mounted between the first pivot member 60 and the vertical section 412 of the associated base member 41 and including a first end 102 and a second end 104, and an elongated second slot 11 is defined in a mediate portion of the operating member 10. A pivot axle 30 includes a first end 302 extending through the second slot 11 of the operating member 10 and securely attached to the vertical section 412 of the associated base member 41 and includes a second end 304 pivotally engaged with the first end 602 of the first pivot member 60. Preferably, the first end 302 of the pivot axle 30 is riveted to the associated vertical section 412, and the second end 304 of the pivot axle 30 extends through and outwardly from a hole 64 defined in the first end 602 of the first pivot member 60 such that the first pivot member 60 is pivoted to the associated vertical section 412 about the pivot axle 30.

A movable member 20 includes a first end 202 attached to the second end 104 of the operating member 10 and a second end 104 movably extending through the first slot 62 and protruding outwardly from the first slot 62. Preferably, the first end 202 of the movable member 20 is securely fitted in a hole 12 defined in the second end 104 of the operating member 10 such that the operating member 10 is moved with the movable member 20 synchronously by means of the second end 204 of the movable member 20 sliding along the first slot 62 of the first pivot member 60. In addition, a knob 26 is securely mounted around the second end 204 of the movable member 20 for facilitating to move the movable member 20 conveniently by a user.

A spring 23 has a first end 232 attached to the second end 304 of the pivot axle 30 and a second end 234 attached to the second end 204 of the movable member 20. The pivot axle 30 comprises a first groove 32 defined in a periphery of the second end 304 thereof for retaining the first end 232 of the spring 23 therein, and the movable member 20 comprises a second groove 22 defined in a periphery of the second end 204 thereof for retaining the second end 234 of the spring 23 therein. The pivot axle 30 further comprises a flange portion 31 with an enlarged diameter formed on the first end 302 thereof and abutting between the operating member 10 and the first pivot member 60, and the movable member 20 further comprises a flange portion 21 with an enlarged diameter formed on the first end 202 thereof and abutting between the operating member 10 and the first pivot member 60.

Figure 3:
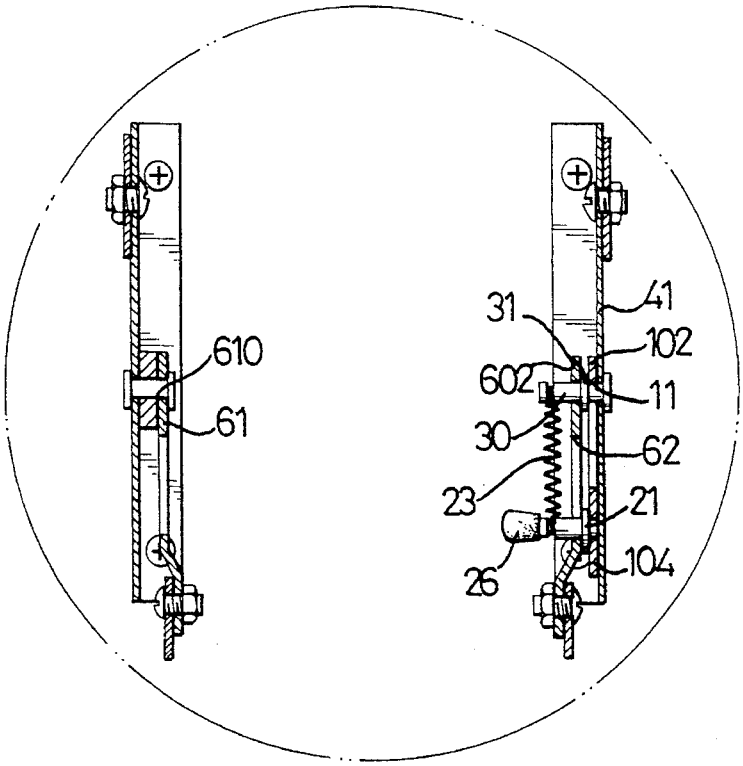
FIG. 3 is a top plan cross-sectional view of the safety device which is arranged in a second status.

Referring to FIGS. 2 and 3, the movable member 20 is restricted to move along the first slot 62 of the first pivot member 60 such that the operating member 10 is displaced between a first position where the first end 102 of the operating member 10 aligns with the first end 602 of the first pivot member 60 such that the first pivot member 60 together with the operating member 10 is pivotally engaged with the vertical section 412 of associated the base member 41 about the pivot axle 30 as shown in FIG. 3, and a second position where the first end 102 of the operating member 10 extends beyond the first end 602 of the first pivot member 60 such that the first pivot member 60 is not pivotally engaged with the vertical section 412 of associated the base member 41 by means of a rotational movement of the operating member 10 being limited by the horizontal section 410 of associated the base member 41, thereby preventing the first pivot member 60 from pivoting relative to the vertical section 412 of associated the base member 41 about the pivot axle 30, bestly shown in FIG. 2.

Figure 5:
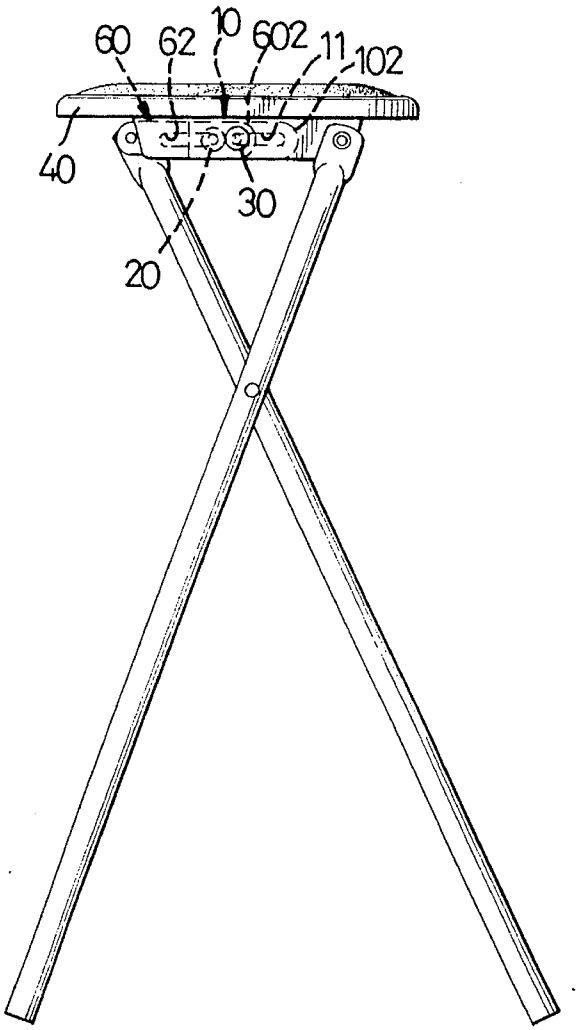
FIG. 5 is a side view of the safety device of FIG. 2.

In operation, referring to FIGS. 2 and 5, the operating member 10 is initially retained in the second position thereof due to the returning action of the spring 23, i.e., the first end 102 of the operating member 10 extends beyond the first end 602 of the first pivot member 60 such that the first pivot member 60 is not able to pivot relative to the associated vertical section 412 by means the pivotal movement of the operating member 10 limited by the associated horizontal section 410, thereby limiting the relative pivotal movement between the first and second pivot members 60 and 61 and the second pair of leg portions 51 so as to limit the relative pivotal displacement between the first and second leg portions 50 and 51, thereby automatically preventing the foldable chair from tipping up even when a user is unintentionally seated on one side of the seat 40 near the first leg portions 50.

Figure 4:
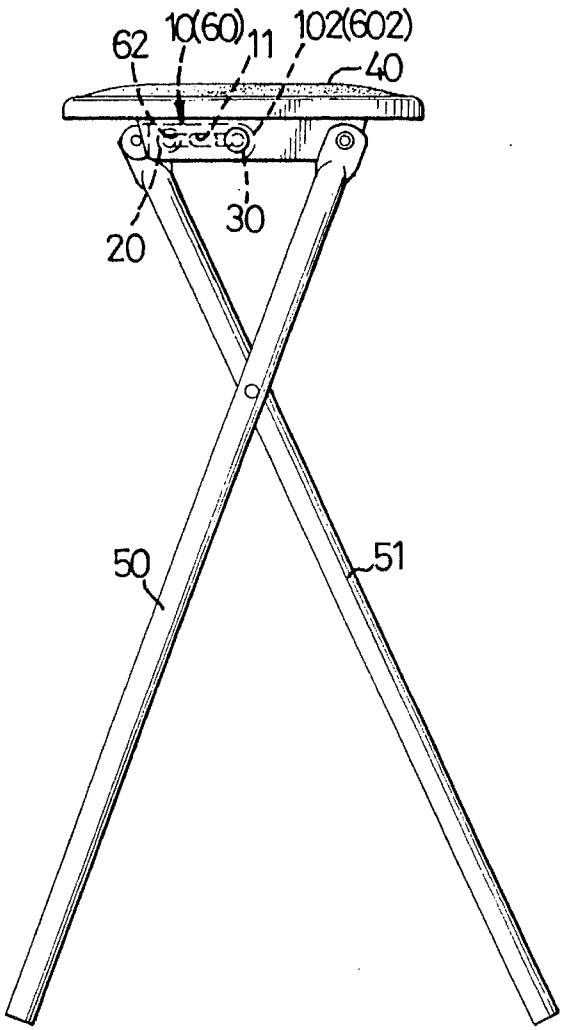
FIG. 4 is a side view of the safety device of FIG. 3.

Conversely, when the user would like to fold the chair, referring to FIGS. 3 and 4, he/she can grip the knob 26 to move the movable member 20 to a place where the operating member 10 is displaced to the first position thereof. In other words, the first end 102 of the operating member 10 aligns with the first end 602 of the first pivot member 60 such that the first pivot member 60 together with the operating member 10 is able to pivot relative to the associated vertical section 412 about the pivot axle 30, thereby allowing the pivotal movement between the first and second pivot members 60 and 61 and the second pair of leg portions 51 so as to allow the relative pivotal displacement between the first and second leg portions 50 and 51, thereby folding the chair.

Figure 6:
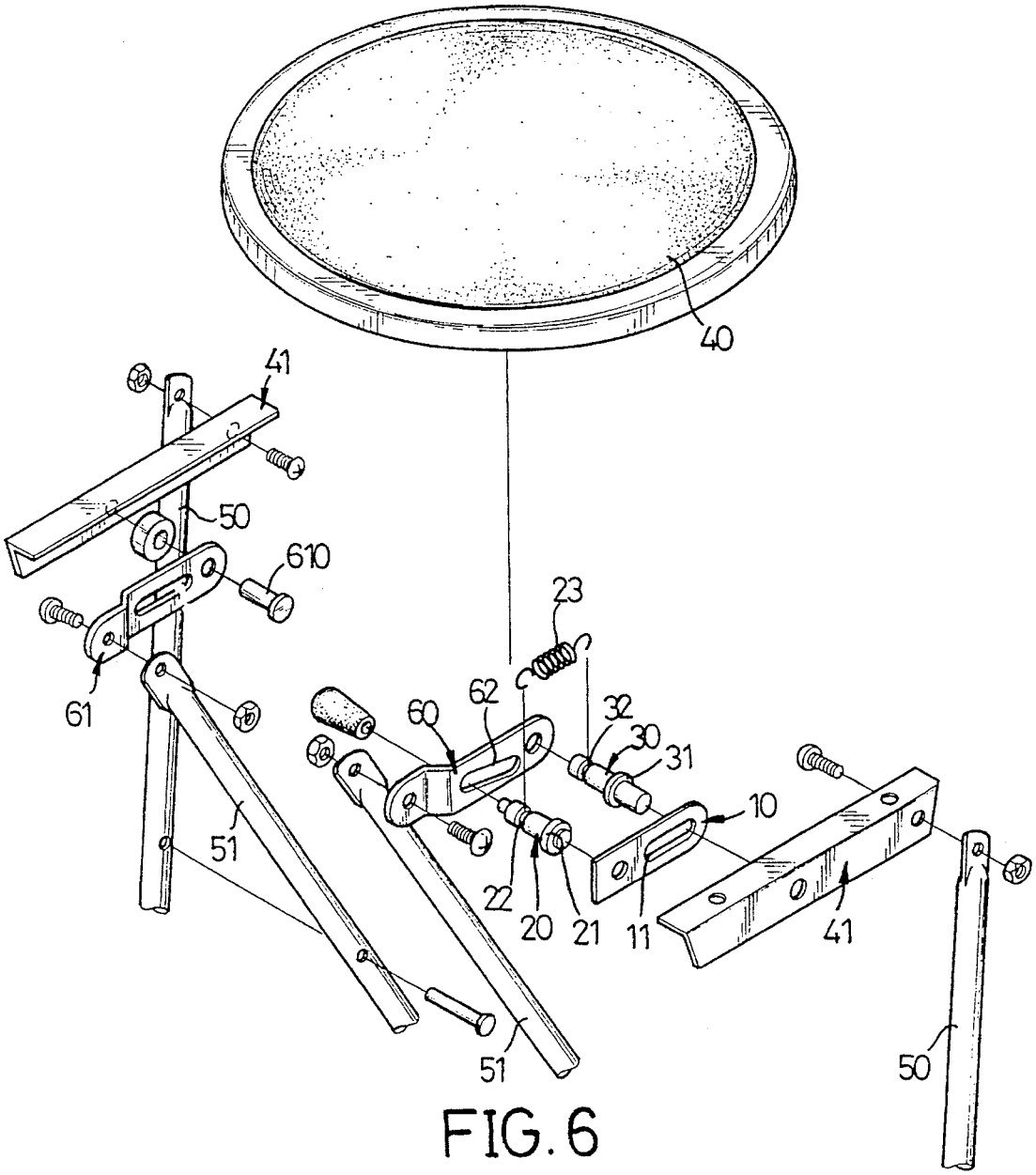
FIG. 6 is an exploded view of a safety device for a foldable chair in accordance with a second embodiment of the present invention.

Referring to FIG. 6, in accordance with another embodiment of the present invention, the first slot 62 of the first pivot member 60 is arranged in a tilting manner, thereby preventing the movable member 20 from becoming loosened, wobbling or sliding easily.

Accordingly, by such an arrangement, the safety device in accordance with the present invention is able to automatically retain the foldable chair in position without a possibility of wobbling or upsetting, thereby preventing from injury occurring to a person seated thereon.

It should be clear to those skilled in the art that further embodiments of the present invention may be made without departing from the teachings of the present invention.

I claim:

1. A safety device for a foldable chair which comprises a seat having an underside, a pair of base members having a substantially inverted L-shaped cross-section each of said base members including a horizontal section fixedly mounted to the underside of said seat and each of said base members including a vertical section having a first end and a second end, a pair of first leg portions each having an upper end pivotally engaged with the first end of said vertical section of a corresponding one of said base members, a first pivot member and a second pivot member each having a first end pivotally engaged with the second end of said vertical section of a corresponding one of said base members and each of said first and second pivot members having a second end, an elongated first slot being horizontally defined in a mediate portion of said first pivot member, a pair of second leg portions each having an upper end respectively and pivotally engaged with the second end of each associated said first and second pivot member, said first and second leg portions being pivotally engaged with each other, thereby allowing pivotal displacement therebetween, said safety device further comprising an operating member slidably mounted between said first pivot member and the vertical section of an associated said base member and including a first end and a second end, an elongated second slot defined in a mediate portion of said operation member, a pivot axle including a first end extending through said second slot and attached to the vertical section of an associated said base member and including a second end pivotally engaged with the first end of said first pivot member, a movable member including a first end attached to the second end movably extending though said first slot, a spring having a fist end attached to the second end of said pivot axle and a second end attached to the second end of said movable member, said movable member is restricted to move along said first slot such that said operating member is displaced between a first position where the first end of said operating member aligns with the first end of said first pivot member such that said first pivot member together with said operating member is pivotally engaged with the vertical section of an associated said base member by means of a rotational movement of said operating member being limited by the horizontal section of an associated said base member, thereby preventing said first pivot member from pivoting relative to the vertical section of an associated said base member about said pivot axle.

2. The safety device in accordance with claim 1, wherein said pivot axle comprises a first groove defined in a periphery of the second end thereof for retaining the first end of said spring therein, said movable member comprises a second groove defined in a periphery of the second end thereof for retaining the second end of said spring therein.

3. The safety device in accordance with claim 1, wherein said pivot axle comprises a flange portion with an elongated diameter formed on the first end thereof and abutting between the operating member and the first pivot member.

4. The safety device in accordance with claim 1, wherein said movable member comprises a flange portion with an enlarged diameter formed on the first end thereof and abutting between the operating member and the first pivot member.

* * * * *